United States Patent [19]

Naulin

[11] 3,951,007

[45] Apr. 20, 1976

[54] CAMS

[75] Inventor: Michel Naulin, Angouleme, France

[73] Assignee: La Telemecanique Electrique, Nanterre, France

[22] Filed: Dec. 26, 1974

[21] Appl. No.: 536,586

[30] Foreign Application Priority Data

Jan. 3, 1974 France ..... 74.00158

[52] U.S. Cl. ..... 74/568 R; 74/568 T; 200/38 BA; 200/153 LB

[51] Int. Cl.[2] ..... F16H 53/00

[58] Field of Search..... 74/568 T, 568 M, 568 R; 200/38 CA, 38 BA

[56] References Cited

UNITED STATES PATENTS

| | | | |
|---|---|---|---|
| 403,169 | 5/1889 | Woodmansee | 74/568 |
| 1,141,504 | 6/1915 | Street | 74/568 |
| 3,488,683 | 1/1970 | Kerfoot, Jr. et al. | 74/568 |
| 3,496,788 | 2/1970 | Muntendam | 74/568 |

*Primary Examiner*—Samuel Scott
*Assistant Examiner*—F. D. Shoemaker
*Attorney, Agent, or Firm*—William A. Drucker

[57] ABSTRACT

A set of removable combination cams has an assembly of identical rotary components mounted on a common rotary shaft and carrying removable cams for operation of switches. The rotary components are coupled together in such a manner that they can move relatively perpendicular to the axis of rotation, so that at least a portion of the periphery of one of the components is uncovered to allow fitting of the cam elements. Thus, the cam elements can be fitted without dismantling the assembly, and without changing the relative angular positioning of the rotary components, and without utilising resilient deformation of the materials employed, whilst retaining small axial dimensions for the assembly.

3 Claims, 10 Drawing Figures

CAMS

The invention relates to a set of removable combination cams comprising a multiplicity of identical rotary components which are not only each capable of taking on the edge a number of removable projecting cams parts intended to operate switches for example, but are intended to be mounted on a common shaft of rotation.

Such sets of cams are particularly advantageous in electric control instruments where the user wishes easily to change the operating programme of a number of switches.

There are already known intruments corresponding to the unit defined above, but wherein the removable parts are held by a snap action making use of the resilient properties of the materials.

These instruments have the disadvantage of allowing the removable cam parts to come away from their seating after they have been working for some time. Further, in order for the rotary components to accommodate the removable cam parts, they must either be spaced from each other axially, which makes it necessary to mount them on a shaft of great length, or else separate, which may lead to alignment errors when reassembling.

When the removable cam parts can be held by mechanical means, the axial dimensions or the complexity of the units confine their use to certain applications.

The object of the invention is therefore to provide a set of cams but wherein the rotary components carry removable cam parts are shaped to allow said cam parts to be fitted without complete dismantling, without changing the relative angular position of the rotary components, without making use of the resilient properties of the materials used, and yet preserving small axial dimensions for the components as a whole. In accordance with the invention, this result is achieved in that the rotary components are locked against relative rotation by a connecting means which nevertheless allows their relative movement in a direction perpendicular to the axis of rotation, so that at least a portion of the periphery of one of the components comprising sockets is uncovered when this movement takes place, to allow the fitting of the removable cam parts.

In accordance with a complementary feature of the invention which is particularly advantageous when the rotary components only move a fraction of a turn and are mounted on a shaft one end of which is accessible, each component takes the form of a segment with a centering aperture and has on one of its faces at least a first set of guiding surfaces orientated towards the centering aperture, and shaped to co-operate with at least a second set of guiding surfaces arranged on the opposite face of the neighbouring component.

Other features of the invention will be better understood by reference to the following description of the accompanying drawings, wherein.

Figure 6A:
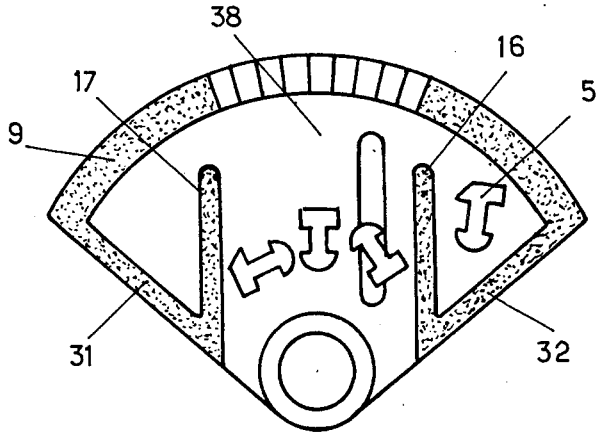
Figure 6B:
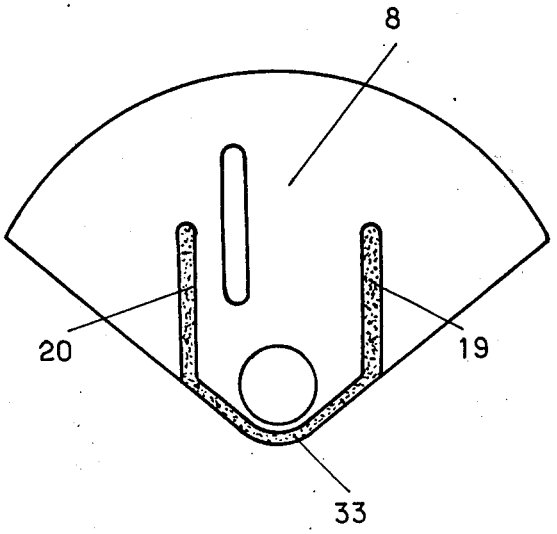
Figure 7A:
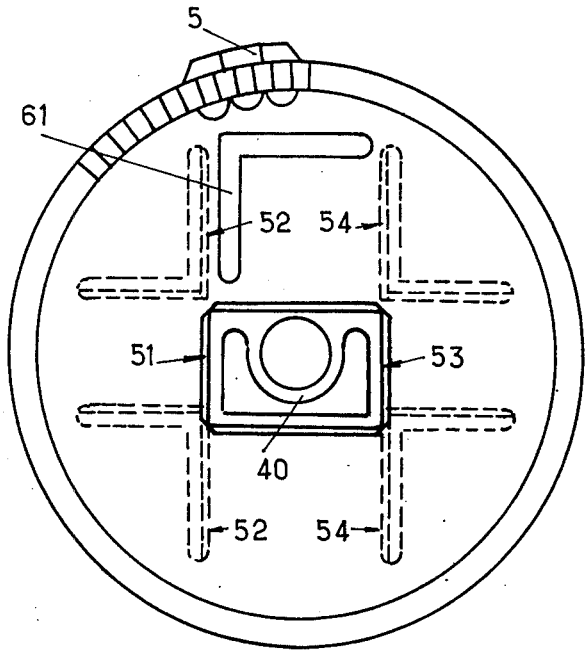
Figure 7B:
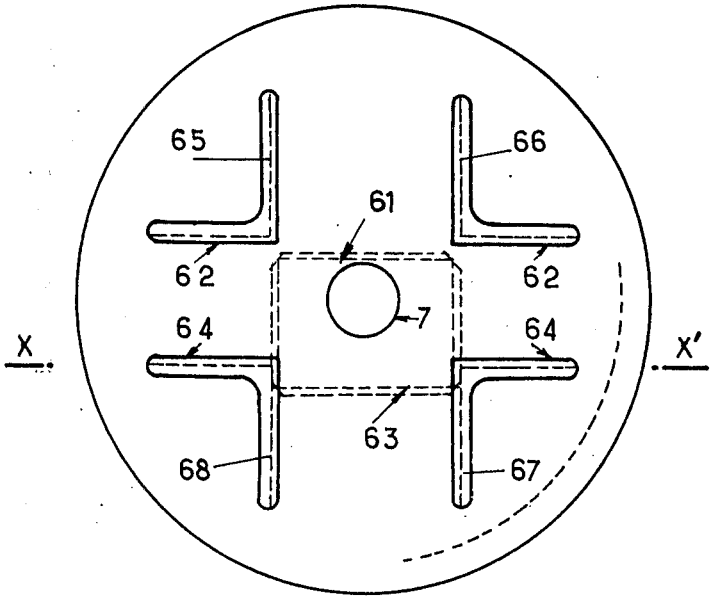
Figure 8:
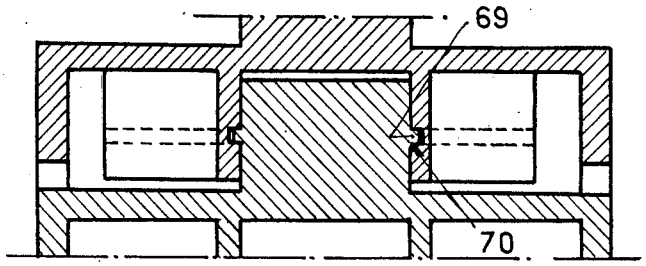

FIGS. 6*a* and 6*b* are respectively a plan view and an underplan view of a rotary component of a second embodiment of switch camming device;

FIGS. 7*a* and 7*b* are respctively a plan view and an underplan view of a rotary component of a third embodiment of switch camming device;

FIG. 8 is a radial section, taken on the line X–X′ of FIG. 7*b* of two of the rotary components assembled together.

Figure 1:
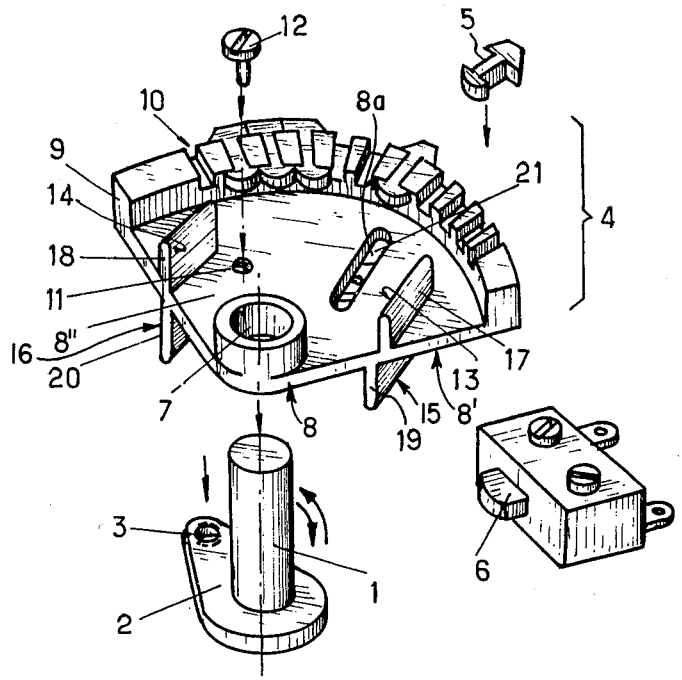
FIG. 1 is a perspective elevation of a first embodiment of switch camming device, with the parts shown in separated condition.

FIG. 1 shows at 1 a portion of a cylindrical shaft integral with an arm 2 having a threaded hole 3.

The rotary component 4 is intended to be integrated with the shaft 1 in order to share the angular movements of the shaft and cause the operation of the switch 6 by means of removable parts 5 fixed on its periphery and acting as cams.

For this purpose, the rotary component consists of a metal plate 8 with two opposed faces 8′, 8″ and comprising a bearing hole 7 to fit on the shaft 1. In the embodiment shown, the plate 8 takes the form of a segment of a circle with a hole 11 and with an annular portion 9 in which are formed notches 10 of substantially radial direction. The size of these notches is arranged to take removable parts such as 5 which, when fitted in these seatings, are flush with the surface of the annular portion perpendicular to the axis of rotation. A screw 12 passing through the holes 11 and 3 enables the shaft 1 and the component 4 to be fixed together.

To change the relationship between the various positions of the shaft 1 and the state of the switch 6, it is sufficient to move parts such as 5 correspondingly.

In FIG. 1, no means are provided to prevent the removable parts 5 from being removed.

Figure 3:
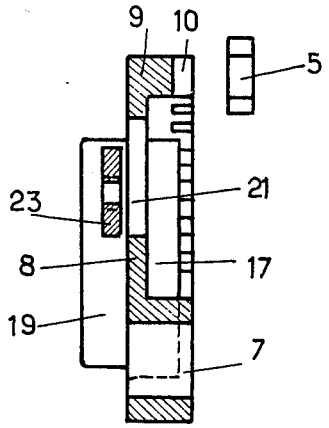
FIG. 3 is a radial section of parts of the first embodiment.
Figure 4:
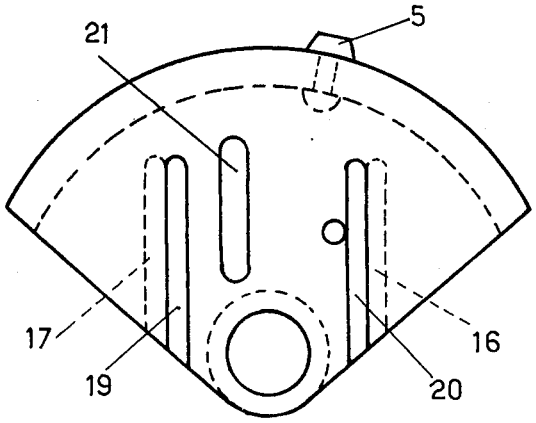
FIG. 4 is a plan view of a rotary component of the first embodiment.

To avoid this disadvantage, and to provide additional advantages, other measures have been taken. Referring also to FIGS. 3 and 4, it will be seen that the plate 8 has on each of its two opposite faces 8′, 8″, two parallel surfaces 15, 16 and 13, 14 respectively. These surfaces are disposed on ribs 17, 18 and 19, 20 respectively in such a way that the plane passing through the surface 13 contains the surface 15, and that the plane passing through the surface 14 contains the surface 16. The height of these ribs is less than the height of the annular portion 9.

An oblong opening 8*a* is provided in the plate 8 and runs parallel to the surfaces 13, 14, 15, 16.

Figure 2:
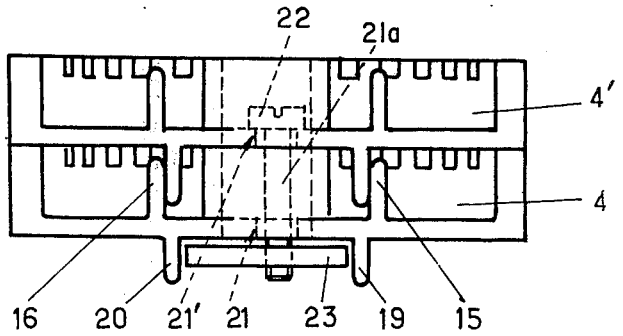
FIG. 2 is an edge elevation of an assembly of two rotary components of the first embodiment.

If, in accordance with what is shown in FIG. 2, at least two rotary components such as 4 and 4′ are connected by superimposing them, the untimely release of the removable components 5 will be prevented. This result can be achieved by means of a securing member such as a screw such as 21a, with a head 22, going through the oblong openings 21, 21′ to screw into a small plate 23 forming a bolt.

Figure 5:
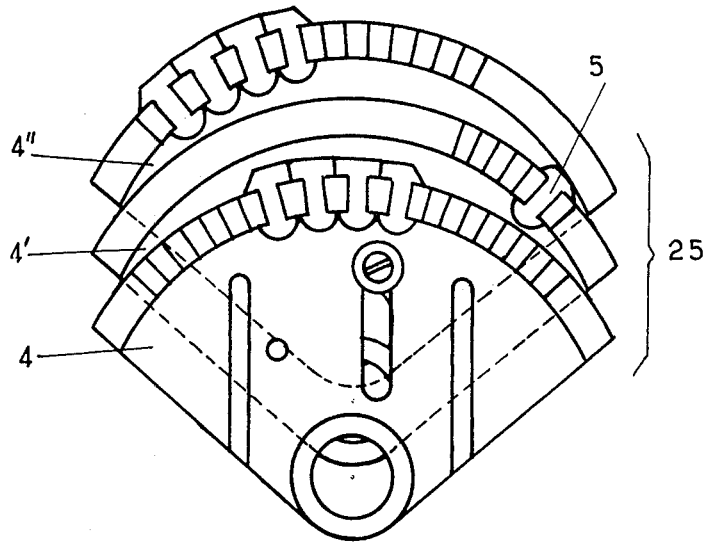
FIG. 5 is a plan view of two rotary components of the first embodiment, seen coupled together but with their axes offset radially.

Due to the length of the oblong openings 8*a* and the co-operation of the ribs on one rotary component with the opposite ribs on the neighbouring rotary component, it is possible to cause a relative radial movement between the two components 4 and 4′, as can be seen in FIG. 5.

This movement therefore makes it possible to uncover the notches 10 in order to fit parts 5 therein without the relative angular position of the components 4 being altered.

It is then extremely easy to select or change, before mounting the set of cams 25 on the shaft 1, a combination of removable parts 5 corresponding to the required switching programme.

FIGS. 6*a* and 6*b* show the two faces of a rotary component similar to the one which has just been described but wherein there has been used the complementary shape of two neighbouring components placed side by side to form a free space for removable parts 5. This space is bounded by two partitions 31, 32 connecting the partitions 17 and 16 respectively to the annular portion 9 and by a curvilinear wall 33 connecting partitions 19 and 20, and also by the plates 8 and 38 respectively of the two neighbouring rotary components.

It can clearly be seen that the positioning of the guide surfaces 13, 14, 15, 16 towards the centering aperture 7 makes it possible to uncover the annular sectors 9 with a small relative movement of two rotary components such as 4, 4′, 4″.

However, the guide surfaces could possibly be in another position.

In the particular case where the rotary components are segments of a circle, the guide surfaces could have circular shapes having the same axis as the centering aperture 7. The relative movement of neighbouring rotary components would then be comparable to the movement of the blades of a fan.

However, this solution is excluded in the case where the rotary components have to perform a full revolution. In order to be able to uncover the annular portions having notches, it is possible in this case either to provide for long guide surfaces, or else to reduce relative movements to provide for two separate sets of guide surfaces 51, 52, 53, 54 and 61, 62, 63, 64 respectively, as shown in FIGS. 7*a* and 7*b* showing the two opposite faces of a third embodiment of rotary component.

As the guide has to ensure that the different rotary components retain or return to the same relative angular position after insertion of the parts 5, the solid body carrying the comparable guide surfaces takes the form of a prism 40 of rectangular section which is eccentric in relation to the centering aperture 7.

The various rotary components are held one against another in this case either by means of a bolt going through suitably-shaped openings 61 or else by providing the prism 40 with small keys 69 and the ribs 65, 66, 67, 68 with corresponding grooves 70 as can be seen in particular in FIG. 8 which shows a section of two neighbouring rotary components coupled together.

I claim:

1. A component for a rotary cam assembly, comprising:

i. a plate including a bearing hole to receive a rotary shaft, and an oblong opening, ii. an annular portion on said plate coaxial with said hole, said annular portion projecting axially from the plate and including a plurality of circumferentially-spaced notches to receive cam elements, iii. a first pair of ribs projecting axially from a first major face of said plate, said first pair of ribs being parallel and each presenting towards the other rib of the pair a surface opposed to and spaced by a distance from said surface of the other rib, iv. a second pair of ribs projecting axially from the second major face of said plate, said second pair of ribs being parallel and each presenting away from the other rib of the pair a surface remote from and spaced by that same distance from said surface of the other rib, said second pair of ribs being parallel to said first pair of ribs, said first and second pairs of ribs being parallel to said oblong opening of said plate, said first pair of ribs and said second pair of ribs extending respectively from said first and second major faces of said plate to the extent that, when two of said components are placed with the plate of one such component overlying and abutting the annular portion of the other component, said first pair of ribs of one such component may engage by said surfaces between said second pair of ribs of the other such component, said oblong opening being of such length that with a securing member engaged therein said components can be moved relatively to the extent that the plate of one component no longer overlies the annular portion of the other component.

2. In combination, two of the components set forth in claim 1, at least one cam element engaged in a notch of a component, and a securing member engaged through the oblong opening of each component and retaining said components in assembly.

3. A rotary cam assembly including the combination of claim 2, and a common shaft engaged through the bearing hole of each component.

* * * * *